US005904312A

United States Patent [19]

Hinz et al.

[11] Patent Number: 5,904,312

[45] Date of Patent: May 18, 1999

[54] REEL SLITTER

[75] Inventors: Joachim Hinz, Kempen; Herbert Muller, Krefeld, both of Germany

[73] Assignee: Voith Sulzer Finishing GmbH, Krefeld, Germany

[21] Appl. No.: 09/100,170

[22] Filed: Jun. 19, 1998

[30] Foreign Application Priority Data

Jul. 10, 1997 [DE] Germany ..... 197 29 530

[51] Int. Cl.[6] ..... B65H 35/02

[52] U.S. Cl. ..... 242/525; 242/530; 242/532.7; 242/535; 242/615.11; 226/95; 226/97.3

[58] Field of Search ..... 242/525, 525.3, 242/530, 530.1, 532.7, 535, 535.2, 535.3, 535.4, 535.5, 615.11; 226/95, 97.3

[56] References Cited

U.S. PATENT DOCUMENTS

| | | | |
|---|---|---|---|
| 2,449,234 | 9/1948 | Knoble | 242/535.4 |
| 4,004,747 | 1/1977 | Schulze | 242/530.1 |
| 4,022,367 | 5/1977 | Sporenberg et al. | 242/532.7 |
| 4,093,141 | 6/1978 | Garrett, Sr. et al. | 242/530.1 |
| 4,183,451 | 1/1980 | Gageur | 242/615.11 |
| 4,336,813 | 6/1982 | Seragnoli | 226/95 |
| 4,508,279 | 4/1985 | Tokuno et al. | 242/532.7 |
| 4,572,450 | 2/1986 | Lindquist | 242/530 |
| 4,621,777 | 11/1986 | O'Connor | 242/525 |
| 4,660,752 | 4/1987 | Rikard et al. | 226/95 |
| 4,726,502 | 2/1988 | Cryderman | 226/97.3 |
| 4,759,512 | 7/1988 | Gaiser | 242/530.1 |
| 4,875,632 | 10/1989 | Kataoka | 242/530 |
| 4,909,454 | 3/1990 | Welp et al. | 242/535 |
| 5,080,297 | 1/1992 | Blaimschein | 242/530 |
| 5,152,471 | 10/1992 | Goerner . | |
| 5,317,885 | 6/1994 | Vignoni | 242/530 |
| 5,442,420 | 8/1995 | Tsuji | 226/95 |
| 5,518,490 | 5/1996 | Ziegelhoffer | 226/95 |
| 5,533,659 | 7/1996 | Meyer | 242/615.11 |
| 5,620,151 | 4/1997 | Ueyama et al. | 242/530 |
| 5,782,425 | 7/1998 | Leskinen et al. | 242/530 |

FOREIGN PATENT DOCUMENTS

| | | |
|---|---|---|
| 509349 | 4/1979 | Australia . |
| 7336269 | 3/1974 | Germany . |
| 2411238 | 9/1974 | Germany . |
| 3036794 | 4/1982 | Germany . |
| 3414636 | 11/1984 | Germany . |
| 2657132 | 4/1986 | Germany . |

*Primary Examiner*—John P. Darling
*Attorney, Agent, or Firm*—Greenblum & Bernstein, P.L.C.

[57] ABSTRACT

A reel slitter includes a slitting station for slitting a material web into partial webs and a winding station to wind the partial webs into partial web rolls. A transporter conveys at least one partial web from the slitting station. The transporter is disposed between the slitting station and the winding station. In order to provide for the winding of the partial webs across the entire width of the partial webs, the transporter has a width which is narrower than the material web. The transporter is also movable transversely to the running direction of the partial webs.

21 Claims, 2 Drawing Sheets

REEL SLITTER

CROSS-REFERENCE TO RELATED APPLICATION

The present invention claims the priority under 35 U.S.C. §119 of German Patent Application No. 197 29 530.4 filed on Jul. 10, 1997, the disclosure of which is expressly incorporated by reference herein in its entirety.

BACKGROUND OF THE INVENTION

1. Field of the Invention

The invention relates to a reel slitter with a slitting station for slitting a material web into partial webs and a winding station to wind the partial webs into partial web rolls. A transporter is utilized for transporting at least a partial web beginning from the slitting station to the winding station. The transporter is disposed between the slitting station and the winding station.

The invention is to be described below with the aid of a paper web as an example of a material web, without the invention being limited thereto.

2. Discussion of Background Information

Paper webs are often produced in widths which are too large for a subsequent user, for example, a printer. In one of the final production steps, the paper webs are thus adjusted to the correct width in the reel slitter, in which the webs are slit into partial webs. In addition, the edges of the paper webs can be straightened by such a step. The partial webs are then wound in the winding station into partial web rolls. The partial web rolls then have a width between approximately 0.4 m and approximately 3.8 m. The diameter of such web rolls is generally greater than approximately 1.0 m. In this case, the material web is either unwound from a so-called jumbo roll, the width and diameter of which is substantially larger, or the material web is supplied directly from the calender.

Particularly, in the last case, it is necessary to perform the starting of a new partial web roll at the production velocity of the calender. For this, it is customarily planned that one first slits a narrow strip which is then transported by means of various transport systems to its point of destination, namely to the reel core in the winding station.

When the partial web roll has arrived at the calender, then web tension is applied to the narrow strips which are continually made wider, until the desired partial web width is attained. In this process, it is certainly disadvantageous that the first paper layers are wound in a telescope-like fashion, which leads to a conical paper roll.

If one wants to fasten the partial web with the entire width on the reel core, to date the only possibility has been to do so manually. However, in the manual operation, one cannot maintain the desired velocity.

Transporters are also known which convey the partial web with the entire desired width. Such transporters operate either with overpressure, in that they blow the paper web via spoilers, or with underpressure, if an air-permeable transport belt is guided over a suction box.

A reel slitter must be as flexible as possible in its slitting cycle; i.e., it must be able to produce partial webs with varying and alternating widths. Accordingly, one would have to furnish the entire working width of the reel slitter with corresponding transporters. However, this is not economically feasible as such transporters are relatively costly.

SUMMARY OF THE INVENTION

The basis of the invention is to make possible the winding of the partial webs at high production speeds and at a reasonable cost. A transporter is provided between the slitter and winding stations, which has a smaller width than the material web and can be displaced transverse to run direction of the partial webs.

All of the partial webs are not wound on the reel simultaneously; that is, the winding of the partial web rolls begins at different times. Once one has started the process, the result, however, is that the partial web rolls are finished at different times. Thus, the transporter is only required to operate at a certain time at a certain partial web roll. When the transfer takes place, the winding of a new partial web roll has begun, then the transporter can be moved to the position of the next partial web roll, the winding of which is ended and in which a new reel core must be wound. In particular, with a continuously operating reel slitter, a relatively narrow and thus cost-effective transporter may be used and which can nevertheless guide to the winding station the beginning of each partial web having a full width and position the partial web on the reel core.

The transporter preferably has a working width adapted to the widest possible partial web. A reel slitter is customarily designed to produce partial webs up to a maximal width. The transporter must not be wider. It is thus sufficient if one synchronizes the transporter to the reel slitter.

The transporter is advantageously divided into segments transverse to the run direction of the partial webs; the segments can be activated individually or in groups. As mentioned above, a reel slitter must be able to produce varying and alternating partial web widths. If the width of the transporter is adapted to the widest possible partial web, then there is the danger—particularly at the beginning of the entire winding process—that the transporter does not seize and convey only one partial web, but rather numerous partial webs. On the other hand, when only individual segments are activated, which, if appropriate, can also be combined with other individual segments, than the transporter can function precisely so that it only conveys the desired partial web. The remaining partial webs remain untouched. Their progression is therefore not influenced negatively.

It is advantageous that individual segments can be steered in various conveying directions. Thus, even during the conveying of partial webs, the segments which do not convey a desired partial web not only remain inactive, but they can also work or run in the opposite direction, so that the adjacent partial webs are prevented from being conveyed in any event.

It is preferable that the transporter and segments of the transporter can be swivelled on an axis which is disposed at one end of the transporter and which extends essentially transverse to the run direction of the partial webs. The axis is disposed on the end which is adjacent to the slitting station. In this manner it is possible to load more than one winding position with the transporter. For example, one can load varying vertically or horizontally displaced winding stations.

A feed roll arrangement is advantageously arranged prior to the transporter, which extends over the width of the material web. The feed roll arrangement draws the material web through the slitting station. The transporter can thus remain restricted to transporting the partial web from the slitting station more precisely, from the feed roll arrangement, to the winding station. The transporter need not, therefore, provide greater tensile forces.

It is advantageous that a return device is disposed toward the pulper in the region of the feed roll arrangement. The return device serves in particular to begin the manufacture of the partial web rolls. Since the transporter always can provide only one (or few) partial web rolls with the partial webs, it is possible to provide for disposing of the partial webs which cannot be wound because they are yet to be guided into the winding station. Such partial webs can back into the pulper. Of course, this translates into a certain amount of loss, since these partial webs have already run through practically the entire manufacturing process. However, this part of the process is dealing with relatively short partial web sections. Further, this situation does not occur very often. Thus, the losses which are caused by this operation are minimal.

The transporter preferably exhibits at least one air-permeable conveyer belt which is guided over a suction box. The suction box then suctions the paper web securely on the conveyer belt. Since the conveyer belt circulates, the paper web is transported with the conveyer belt and can be transported to the desired position.

It is preferred that the conveyer belts of the numerous segments are provided with a joint drive and the suction boxes of these segments can be controlled individually. The conveyer belts are set into motion together. However, only those conveyer belts, the suction boxes of which are steered, can develop a transport effect, that is, produce an under-pressure so as to convey the paper web.

In an alternative or additional embodiment, the transporter is provided with at least one conveyer plate which is equipped with air jets. Like an air cushion, air is expelled through such conveyor plates at a high velocity and transports the partial web. Depending on the width of the partial webs, segments necessary for conveying are changeable and, accordingly, a larger or smaller number of airjets are actuated.

Thus, an object of the invention is to provide a slitting station for slitting a material web into partial webs. A winding station is provided so as to wind the partial webs into partial web rolls. In order to provide for the winding into partial web rolls, a transporter is positioned between the slitting station and the winding station so as to convey at least one partial web from the slitting station to the winding station. The transporter has a width which is narrower than a width of the material web and is movable in a direction transverse to a run direction of the partial webs.

Another object of the invention is to provide the transporter with a working width that corresponds to the widest possible partial web to be wound.

A further object of the invention is to provide a transporter that is divided into segments transverse to the run direction of a partial web. The transverse segments are operable individually and in groups of segments.

Yet another object of the invention is to ensure that the segments can vary in transport directions of the partial webs.

A further object of the invention is to provide for the transporter to be swiveled on an axis which is positioned at one end of the transporter and extends essentially transverse to the run direction of the partial webs.

Yet another object of the present invention is to provide for the feed roll arrangement to the slitter to be positioned upstream of the transporter so as to extend over the width of the material width.

Another object of the invention is to provide a return device that is positioned in a direction extending toward a pulper which is located adjacent to the feed roll arrangement.

A further object of the invention is to provide a transporter which includes at least one air-permeable conveyor belt added over a suction box.

A further object of the invention is to provide a transporter which includes segments that are capable of being jointly driven and to also provide suction boxes on the transporter that can be individually controlled.

A further object of the invention is to include a return device that is positioned in a direction which extends toward a pulper that is located adjacent to the feed roll arrangement of the reel slitter.

Another object of the invention is to provide a transporter which includes at least one conveying plate that is provided with air nozzles.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
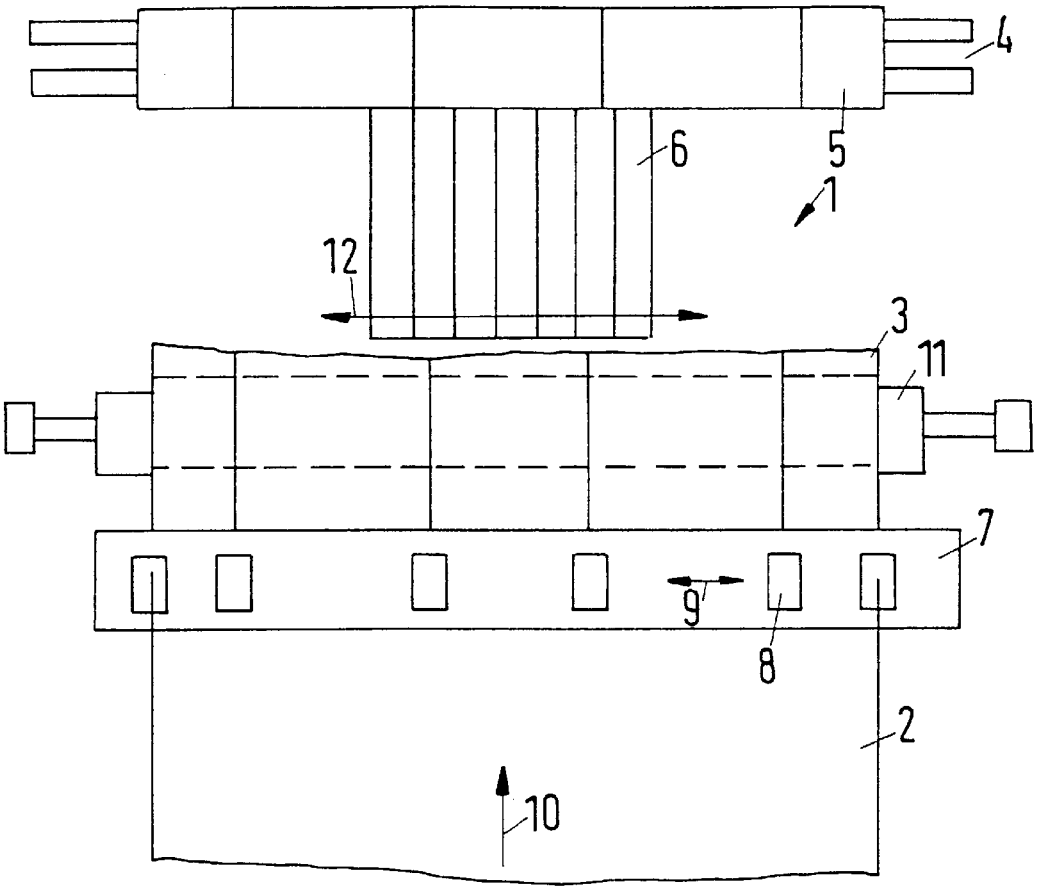
FIG. 1 is a schematic top-view of a reel slitter.

FIG. 1 shows a reel slitter 1 for slitting a material web, in this case a paper web 2, into partial webs 3. The partial 3 webs are wound into partial web rolls 5 in a winding station 4. For clarity's sake, the partial webs 3 are shown in FIG. 1 with a transverse cut, so that one can recognize a transporter 6, which otherwise would be covered by the partial webs 3.

The reel slitter 1 includes a slitting station 7 with knives 8 which can be moved in the direction of double arrow 9, in order to produce various slitting patterns, that is, partial web widths. The paper web 2 has a run direction 10. The partial webs 3 run in the same direction, after they have passed through the slitting station 7. A feed roll arrangement 11 is disposed downstream of the slitting station 7, which, if appropriate, can include a feed roll pair.

With the reel slitter depicted in FIG. 1, even at high production speeds, that is, at high velocities of the paper web 2, it is desired for the partial webs 3 to be guided over their entire width to the winding station 4, even at the beginning of a winding process. This is the purpose of the transporter 6.

As can be ascertained from FIG. 1, the transporter 6 is narrower than the paper web 2; that is, in the case under consideration, the transporter exhibits a significantly narrower width than the paper web 2. The transporter need only be wide enough so that it can support the widest possible partial web 3 across the fill width of the widest partial web.

Since the transporter cannot support all partial webs 3 because of its narrow width, the transporter can be moved in the direction of the double arrow 12, i.e., transversely to the run direction 10 of the paper web 2. The transporter is always moved to a partial web 3, with which an exchange of the partial web roll 5 is necessary, that is, with which a partial web roll 5 is completely wound and the partial web 3 must be transferred onto a new roll core.

Figure 2:
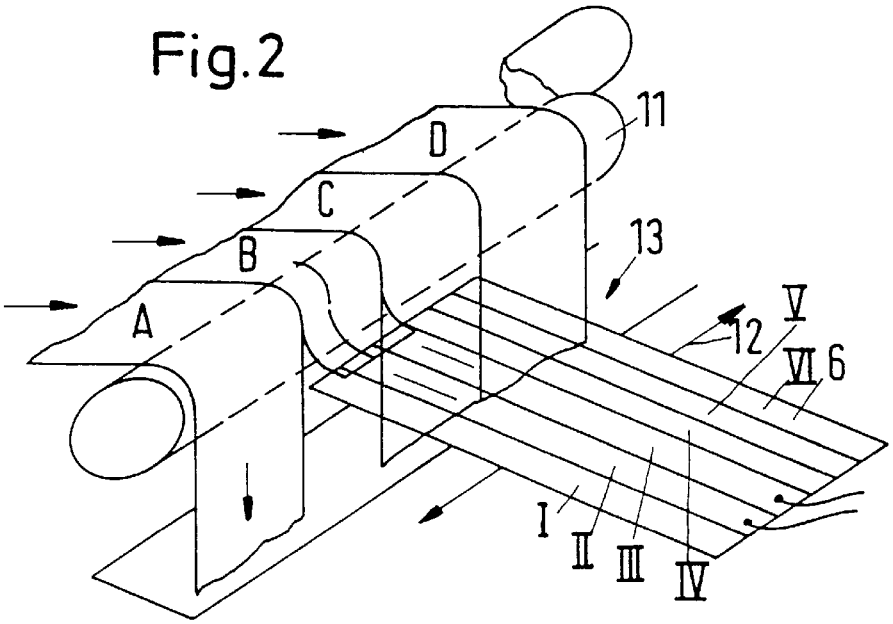
FIG. 2 is a schematic perspective depiction for clarifying the operation of a transporter.

FIG. 2 shows the beginning of a winding process, in which four partial webs are guided over the feed roll arrangement 11. The individual partial webs are marked with the letters A–D. In the present case, the partial web B is to be guided into the winding station first. The remaining partial webs A, C, and D are guided back to the pulper by a drive shaft 13.

The transporter 6 has a greater width than partial web B. However, the transporter 6 is divided into numerous adjacently disposed segments I–VI. These segments can be activated individually; that is, the conveying effect of the transporter 6 can be restricted to certain segments. In the present case, only two segments are activated, namely segments II and III, the combined widths of which correspond approximately to the width of partial web B. The remaining segments remain inactive. Under some circumstances the remaining segments can also be activated in the reverse transport direction so that the adjacent partial webs A and C are not unintentionally transported.

Once the transition of the partial web B into the winding station has occurred, then another partial web can be slit and then transported to winding station 4 with the aid of the transporter 6 in the same manner as described with respect to the partial web B. The partial webs 3 can be provided with a straight front edge, that is, the front edge of the partial webs run transverse to the run direction. The partial web rolls are thus wound uniformly from the beginning, so that no discontinuity in width arises.

The width of the segments I–VI of the transporter 6 can be constant or uniform. However, varying width segments can also be selected; for example, the width of a segment can double from one section to the next. With relatively low cost, a segment combination can always be selected which is adapted to the width of the respective partial web to be conveyed.

Some losses are incurred at the beginning of the winding process, because the partial webs A, C, and D are guided back into the pulper. As soon as this winding process has begun, these losses no longer occur and usually they do not occur again during the later exchange of the partial web rolls. A partial web roll, the winding of which began earlier, is also finished earlier, so that the individual partial web rolls must always be exchanged at different times. In this case, a single transporter 6 which can be moved in the direction of the double arrow 12 suffices.

Figure 3:
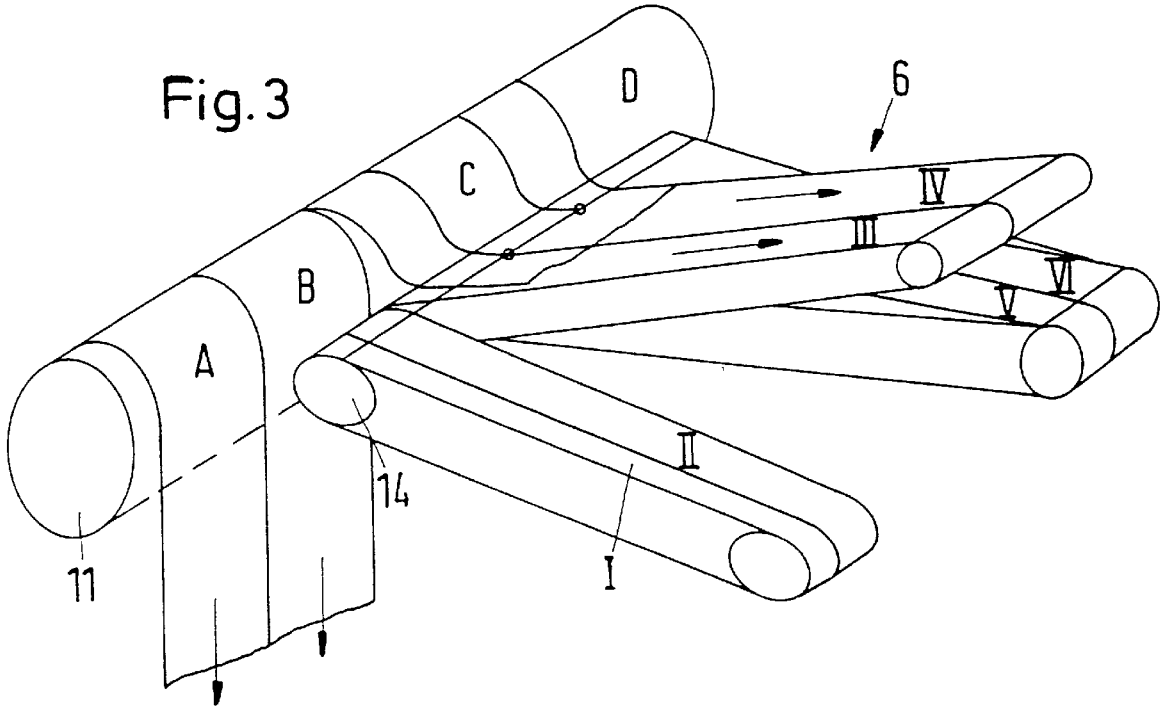
FIG. 3 is a depiction of the transporter of FIG. 2 in a modified form.

FIG. 3 shows that the transporter 6 can be swivelled about an axis 14, which is disposed at an end of the transporter 6, and, to be precise, at the end adjacent to the feed roll arrangement 11. The transporter 6 can be constructed such that the individual segments I–VI can be swivelled independently of each other. In the present case, the segments III and IV, which convey the partial web C, are swivelled, such that they convey the partial web C to a winding station which is displaced from another winding station to which the segments I, II and V, VI would advance. The displacement can occur not only in the depicted vertical direction, but also in a horizontal direction.

Figure 4:
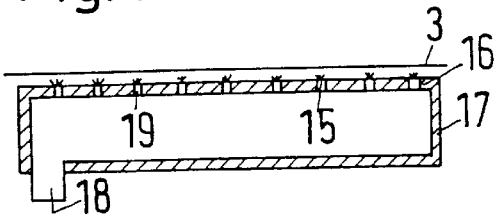
FIG. 4 illustrates a first embodiment of a transporter.

There are different possibilities for the construction of such a transporter 6. FIG. 4 shows a first embodiment, in which the partial web 3 is conveyed on an air cushion which is formed by airjets 15, expelled from a spoiler 16. The spoiler 16 forms the upper bordering wall of a blow box 17, to which pressurized air is supplied via a connection 18. In the embodiment depicted in FIG. 4, the blow box 17 serves to support the partial web 3. Additionally, the air jets 15 emanate from nozzles 19. The nozzles 19 can be moved to predetermined positions. By assigning the nozzles to a predetermined position, the air jets 15 can be used to drive or convey the partial web 3.

Figure 5:
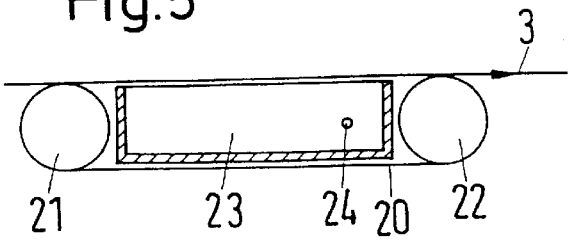
FIG. 5 illustrates a second embodiment of a transporter.

Another embodiment is depicted in FIG. 5, which can also be driven jointly with the embodiment in accordance with FIG. 4. For example, the embodiments can be arranged in a row in accordance with FIGS. 4 and 5. In FIG. 5, the transporter includes a circulating transport belt 20, which is guided over the deflection rolls 21, 22. The transport belt 20 is guided with its upper seam over a suction box 23, from which running air from the partial web is suctioned off via a connection 24. Since the transport belt 20 is air-permeable, the partial web 3 is firmly suctioned to the upper seam of the partial belt 20 in the region between the two deflection rolls 21, 22.

The axis of the deflection roll 21 can simultaneously serve as the axis 14 of FIG. 3, on which the transporter 6 and segments of the transporter can be swivelled. All deflection rolls 21 which are arranged on the axis can be driven by a single driver. The activation of the individual segments then occurs because a lower pressure is created in the suction box 23 in only in those segments in which the partial web 3 is to be conveyed.

It is noted that the foregoing examples have been provided merely for the purpose of explanation and are in no way to be construed as limiting of the present invention. While the invention has been described with reference to preferred embodiments, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A reel slitter comprising:

a slitting station for slitting a material web into partial webs;

a winding station to wind the partial webs into partial web rolls; and a transporter positioned between the slitting station and the winding station to convey at least one partial web from the slitting station to the winding station, the transporter having a width which is narrower than a width of the material web and being movable in a direction transverse to a run direction of the partial webs.

2. The reel slitter in accordance with claim 1, wherein the transporter has a working width corresponding to a widest possible partial web.

3. The reel slitter in accordance with claim 2, wherein the transporter is divided into segments transverse to the run direction of the partial webs; the segments being operable individually and in groups of segments.

4. The reel slitter in accordance with claim 3, wherein the segments can vary transport directions of the partial webs.

5. The reel slitter in accordance with claim 4, wherein the transporter can be swivelled on an axis positioned at one end of the transporter and extending essentially transverse to the run direction of the partial webs.

6. The reel slitter in accordance with claim 2, wherein the transporter can be swivelled on an axis positioned at one end of the transporter and extending essentially transverse to the run direction of the partial webs.

7. The reel slitter in accordance with claim 2, wherein a return device is positioned in a direction extending toward a pulper located adjacent to the feed roll arrangement.

8. The reel slitter in accordance with claim 1, wherein the transporter is divided into segments transverse to the run direction of the partial webs; the segments being operable individually and in groups of segments.

9. The reel slitter in accordance with claim 8, wherein the segments can vary transport directions of the partial webs.

10. The reel slitter in accordance with claim 9, wherein the transporter includes at least one conveying plate provided with air nozzles.

11. The reel slitter in accordance with claim 8, wherein a feed roll arrangement is positioned upstream of the transporter to extend over the width of the material web.

12. The reel slitter in accordance with claim 8, wherein the transporter includes at least one air-permeable conveyer belt guided over a suction box.

13. The reel slitter in accordance with claim 1, wherein the transporter can be swivelled on an axis positioned at one end of the transporter and extending essentially transverse to the run direction of the partial webs.

14. The reel slitter in accordance with claim 13, wherein a feed roll arrangement is positioned upstream of the transporter so as to extend over the width of the material web.

15. The reel slitter in accordance with claim 13, wherein the transporter includes at least one air-permeable conveyer belt guided over a suction box.

16. The reel slitter in accordance with claim 13, wherein the transporter is positioned in a direction extending toward a pulper located adjacent to the feed roll arrangement.

17. The reel slitter in accordance with claim 1, wherein a feed roll arrangement is positioned upstream of the transporter so as to extend over the width of the material web.

18. The reel slitter in accordance with claim 17, wherein a return device is positioned in a direction extending toward a pulper located adjacent to the feed roll arrangement.

19. The reel slitter in accordance with claim 1, wherein the transporter includes at least one air-permeable conveyer belt guided over a suction box.

20. The reel slitter in accordance with claim 19, wherein the transporter includes segments having a joint drive and suction boxes that can be controlled individually.

21. The reel slitter in accordance with claim 1, wherein the transporter includes at least one conveying plate provided with air nozzles.

* * * * *